US009653058B2

(12) United States Patent
O'Connor

(10) Patent No.: US 9,653,058 B2
(45) Date of Patent: May 16, 2017

(54) REVERBERATION-INDUCED MAGNETIC FIELD ALTERATION TO ENHANCE SOUND

(71) Applicant: Philip J. O'Connor, Ulster Park, NY (US)

(72) Inventor: Philip J. O'Connor, Ulster Park, NY (US)

(73) Assignee: Philip J. O'Connor, Ulster Park, NY (US)

( * ) Notice: Subject to any disclaimer, the term of this patent is extended or adjusted under 35 U.S.C. 154(b) by 143 days.

(21) Appl. No.: 14/506,620

(22) Filed: Oct. 4, 2014

(65) Prior Publication Data

US 2016/0098979 A1 Apr. 7, 2016

(51) Int. Cl.

| | |
|---|---|
| ***G10H 3/14*** | (2006.01) |
| ***G10H 3/18*** | (2006.01) |
| ***H04R 1/46*** | (2006.01) |

(52) U.S. Cl.

CPC ..... *G10H 3/146* (2013.01); *G10H 3/181* (2013.01); *G10H 3/183* (2013.01); *H04R 1/46* (2013.01)

(58) Field of Classification Search

CPC ..... G10H 3/146; G10H 3/181; G10H 3/183; H04R 1/46; G10D 1/005; G10D 1/08

USPC ..... 84/725

See application file for complete search history.

(56) References Cited

U.S. PATENT DOCUMENTS

| | | | | |
|---|---|---|---|---|
| 2,645,969 | A * | 7/1953 | Daniel | G10H 3/09 360/130.32 |
| 3,288,906 | A * | 11/1966 | Burns | G10H 3/185 84/726 |
| 4,429,314 | A * | 1/1984 | Albright | H01Q 19/09 343/788 |
| 2006/0174753 | A1* | 8/2006 | Aisenbrey | G10H 1/32 84/600 |
| 2006/0208383 | A1* | 9/2006 | Aisenbrey | H01F 1/083 264/104 |
| 2009/0158912 | A1* | 6/2009 | Nesbitt | G10D 3/10 84/297 S |
| 2013/0312590 | A1* | 11/2013 | Truchsess | G10H 3/146 84/725 |

* cited by examiner

*Primary Examiner* — Jeffrey Donels

(57) ABSTRACT

A passive feedback mechanism by which sound produced by a musical instrument is enhanced by utilizing the reverberations from the sound to dynamically and passively alter the magnetic field in the vicinity of an electronic pickup is disclosed. This is accomplished by utilizing a component or material adhered to the instrument with the property to alter the magnetic field as the material vibrates in response to sound reverberation, one embodiment being a ferromagnetic surface coating. An electromagnetic pickup, sensitive to these variations in the magnetic field, is installed on or within the instrument. The changes in the magnetic field, in response to the music, are captured by the pickup and transformed into an electric signal with thus produce a unique and enhanced sound.

11 Claims, 7 Drawing Sheets

REVERBERATION-INDUCED MAGNETIC FIELD ALTERATION TO ENHANCE SOUND

FIELD OF THE INVENTION AND BACKGROUND

The present invention relates to techniques for modifying and enhancing sound and music and more specifically for transforming and enhancing the sound produced from an otherwise non-electrical instrument.

BACKGROUND AND PRIOR ART

The earliest musical instruments functioned by an operator manually interacting with the instrument to create a specific vibration in order to produce a corresponding musical tone. These instruments are called "acoustic" because they rely on the mechanics of acoustics to generate vibrations that produce sounds. A simple drum or lute is considered an acoustic instrument. A drum can be constructed with a tightly pulled animal skin or other thin, semi-elastic material that upon being hit, vibrates in response, creating a specific and reproducible tone.

Wooden string instruments as well produce sound by vibration. As each string vibrates, unique tones and notes can be produced. The sound quality is further enhanced by reverberations within the hollow chamber or sound-cavity of the instrument. The wooden construction gives the instrument its unique and distinctive sound.

There are many other examples of traditional musical instruments that work by the user interacting with it to cause specific vibrations of the instrument to create the intended sounds. Purely mechanical systems and methods of creating music by natural acoustics have drawbacks which include limits in volume and tonal variation.

As musical instruments evolved, electric instruments were developed that addressed some of the limitations associated with acoustic instruments. One of the first advances was the use of a microphone to amplify the sound.

Other enhancements followed and there are now a wide variety of electric instrument designs used to create music. One of the more common devices is a magnetic pickup were variations in a magnetic field produced by vibrating metal strings is captured as an electrical signal used to produce sound. The workings of electric guitars and its highly recognizable iconic sound come from this method and various systems of vibrating metal strings.

Sophisticated electronics now provide easy selection and fine tuning of a wide range of tones and subtle sound variations for the musician. However, a disadvantage of utilizing a substantially electrical means to produce sounds is that the instrument itself no longer retains a unique sound quality and characteristic. This may seem moot, but in some ways it is actually profound. It is like saying that there is no need for an expert violinist to use a Stradivarius violin because an electronic chip is all that is needed to produce equivalent sound quality. Expert musicians would likely cringe at even the thought of such an allegation. It is undeniable that there is something unique and desirable in the characteristics of sound produced through passive means associated with the instrument itself.

Thus there is a need to provide new systems and methods for producing an even wider range of acoustic instrument sounds and means to enhance the sound without the need for sophisticated electronics where the means is substantially disassociated with the instrument itself.

The term "passive means" or "passive component", used throughout this disclosure, is intended to denote a means or component that provides an altering function with the ability to act upon and change something without the need for additional applied power for it to function. For example, an electronic amplifier is not passive because it requires additional electric power for it to operate on the signal it is to amplify. A parabolic dish on the other hand is passive in that it can amplify sound or radio signals without external power. A glass lens or fiber optic cable is passive as well because it can redirect light waves without the need for external power. Resistors, capacitors and inductors are known as "passive" electrical components because unlike a transistor which requires the application of additional external power in order for it to operate, the passive components can alter the electrical waveform (voltage or current waveforms) passing through them without the application of additional external power.

This leads to yet another disadvantage of electric means for enhancing sound in that most require additional electric power for the electronics to function and act upon the sound signal which is most often in the form of an electrical signal when it is acted upon before being converted back into sound.

SUMMARY

The present invention provides a system and method for producing enhanced musical sounds from an otherwise acoustic instrument. Modifications are made in order to endow the instrument with more unique and inherent sound enhancement capabilities and characteristics.

In one preferred embodiment of this invention, a dynamic microphone is used as a sound pick-up for an acoustic guitar. A typical dynamic microphone is designed with a cone that passively amplifies sound before the sound impacts a diaphragm attached to a wire coil positioned in a magnetic field. The diaphragm moves the wire coil in response to the sound. The magnitude of the sound impacting the diaphragm produces a comparable movement of the coil attached to it. The movement in response to the sound induces a current in the wire coil per Lenz's Law which teaches us that an electric current will be induced in a closed wire loop if and only if magnetic flux through the loop, the component of the magnetic field perpendicular to the loop, is changing. The movement produces a changing magnetic flux thus the magnitude of the current in the wire coil is an electrical representation of the sound.

The magnetic field of a dynamic microphone is typically produced by a permanent magnet located near the wire loop attached to the diaphragm. One preferred embodiment of my invention further alters the magnetic flux through the pickup coil produced by the movement of the ferric or magnetic particles adhered to the surface of the acoustic guitar.

BRIEF DESCRIPTION OF THE DRAWINGS

A more complete understand of the present embodiments and advantages thereof may be acquired by referring to the following description taken in conjunction with the accompanying drawing, in which like numbers indicate like features and wherein.

DETAILED DESCRIPTION

The preferred embodiments and their advantage are best understood by FIGS.

Figure 1:
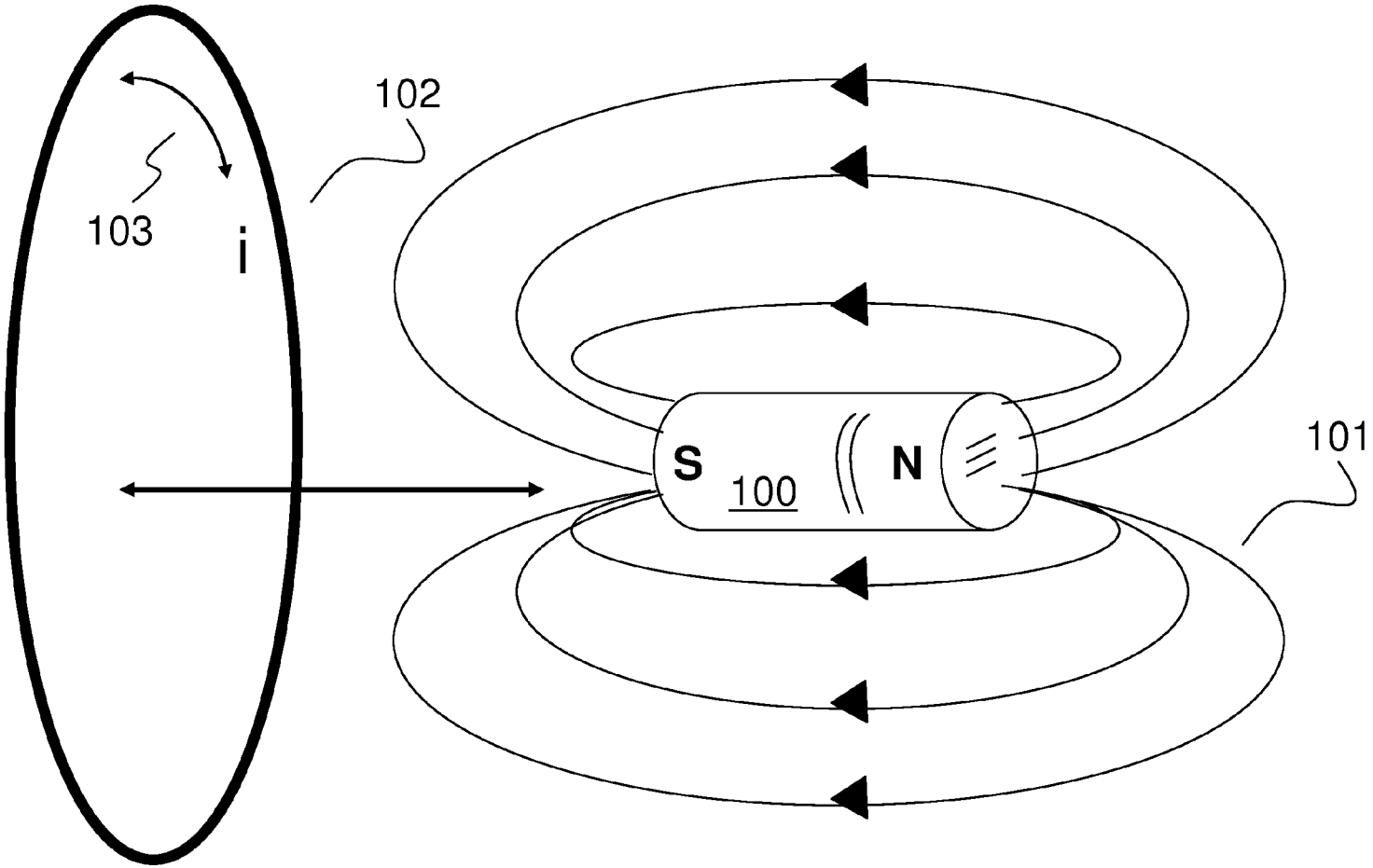
FIG. 1 illustrates a magnet, the magnetic field lines that emanate from said magnet and a wire loop with induced current i.

FIG. 1 is an illustration of a magnet 100 with magnetic field lines 101 emanating from it. When said magnet 100 is moved towards or away from the wire loop 102, the magnetic field illustrated by field lines 101 changes interacting with wire loop 102 producing a current 103 designated as i in said wire loop. The current i is created in a direction that causes it to produce an opposing magnetic field in accordance with Lenz Law. Changes in the magnetic field through the plane of the loop, in this example caused by moving the magnet back and forth in the vicinity of said loop, produces corresponding changes in the magnitude of the current in the wire loop. The current is produced by the component of the magnetic field that penetrates the wire loop perpendicular to the loop plane.

Figure 2:
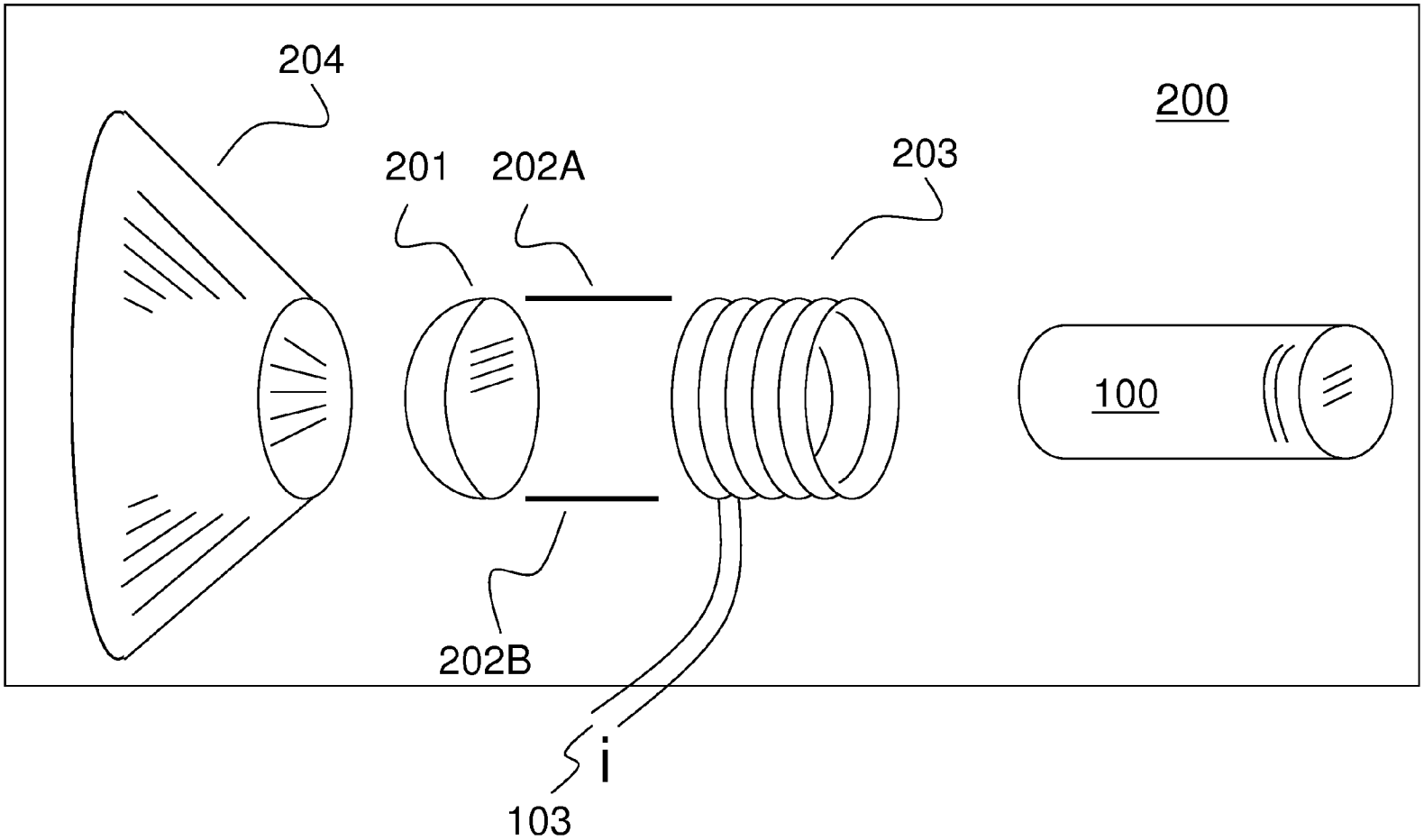
FIG. 2 is a 3 dimensional exploded perspective view of one embodiment of a dynamic microphone.

FIG. 2 is a three-dimensional exploded perspective view illustration of one embodiment of a dynamic microphone acoustic pickup 200 composed of passive sound amplification cone 204, diaphragm 201, attachment arms 202A and 202B used to secure the diaphragm 201 to wire coil 203 and magnet 100. When sound stimulus impacts the diaphragm, it causes the coil to move in response to said sound stimulus and pushes it through the magnetic field thus producing a changing magnetic flux that induces electric current 103 in the wire coil. The current wave form produced is an electrical representation analogous to the sound impacting upon said diaphragm.

Figure 3:
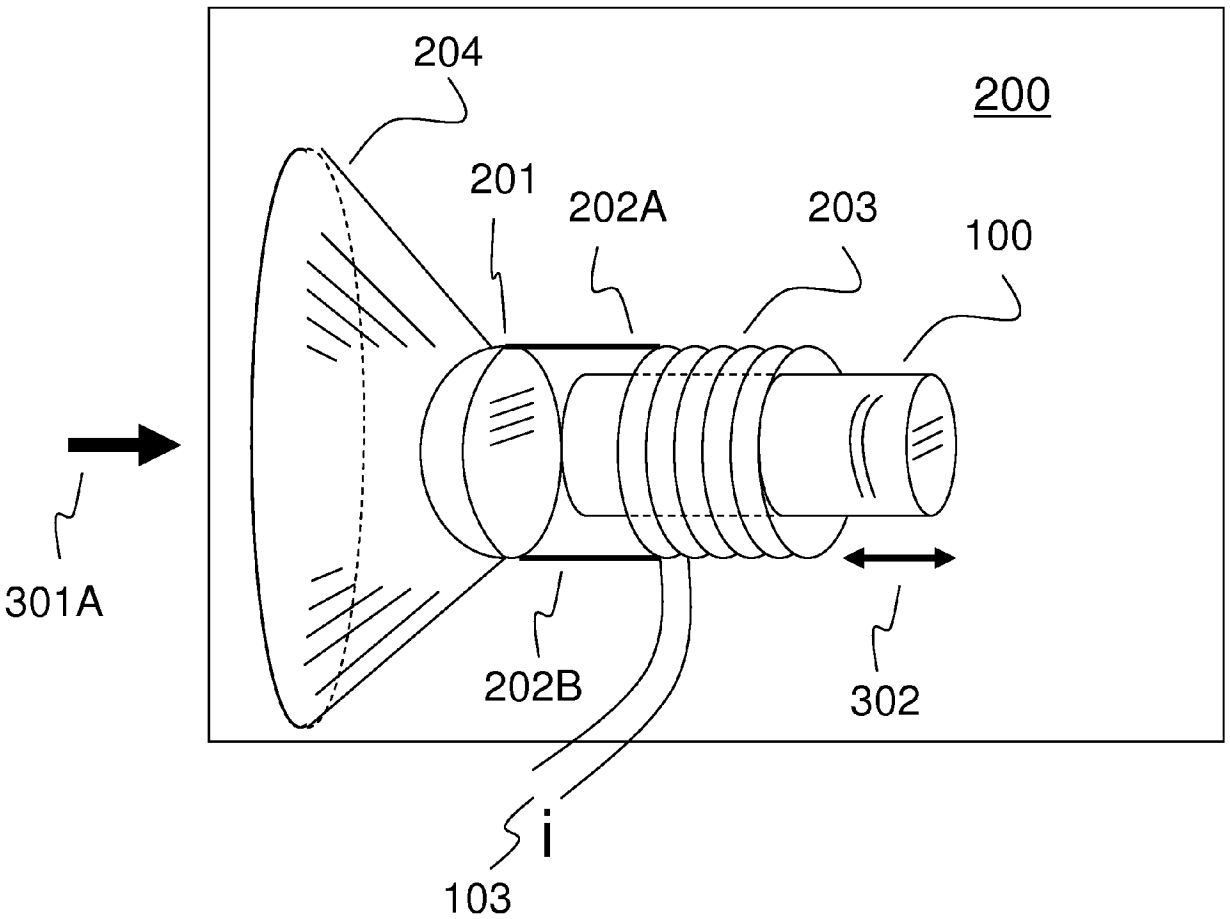
FIG. 3 illustrates a perspective view of the same embodiment as in FIG. 2 of a dynamic microphone.

FIG. 3 is the assembled view of the same embodiment of a dynamic microphone 200 as is illustrated in FIG. 2 with sound stimulus 301A added. Said sound stimulus causes coil 203 to move in response as indicated by arrow 302.

Figure 4:
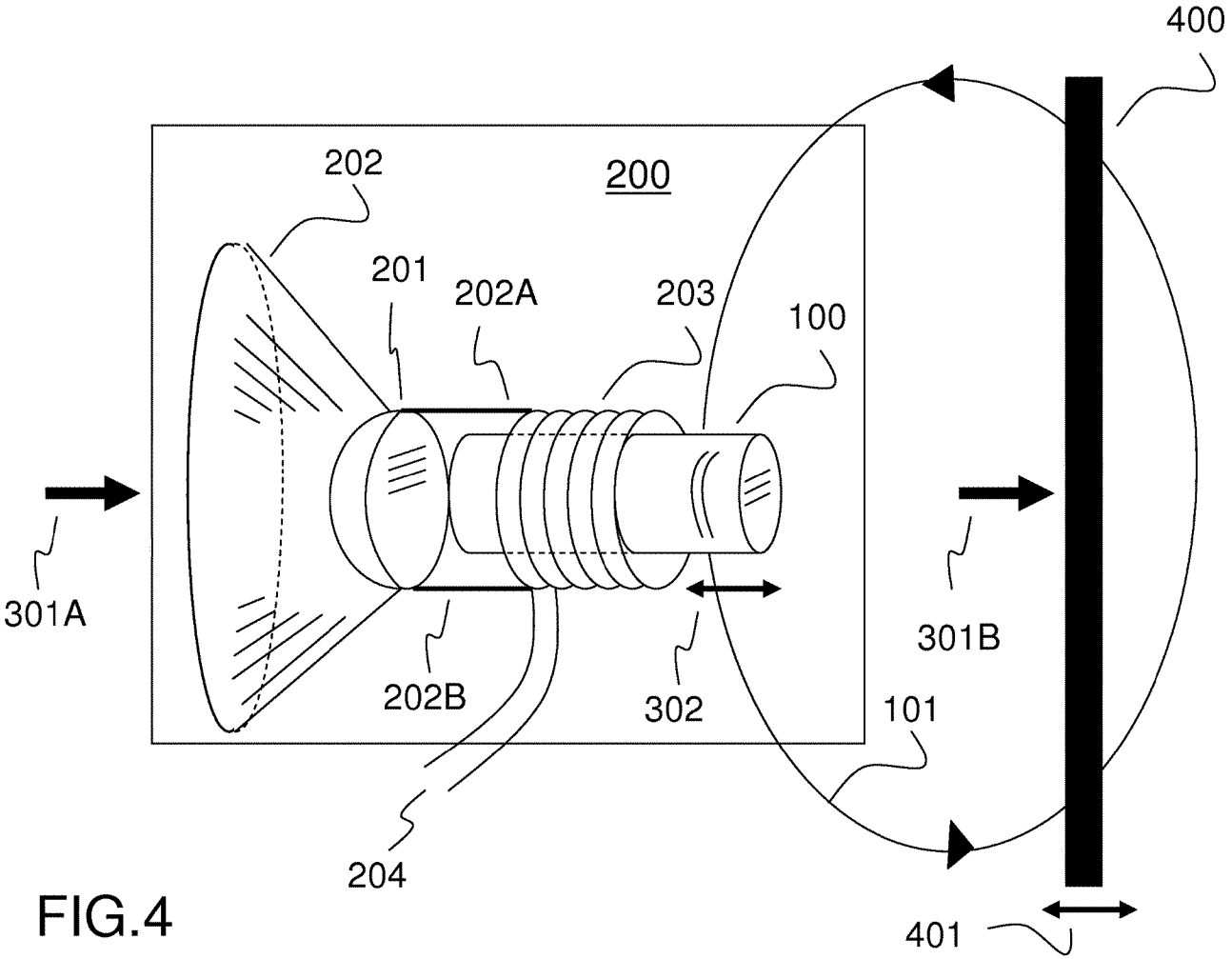
FIG. 4 illustrates the same embodiment of FIG. 3, but in addition the portion of the microphone's magnetic field that is altered by passing through a specialized material layer is added.

FIG. 4 illustrates the same embodiment of a dynamic microphone 200 as in FIG. 3, but this time the portion of dynamic microphone 200 magnetic field 101 that is altered by passing through material layer 400 is also shown. In addition, sound stimulus 301B, which is similar to 301A but delayed in time slightly and of a different magnitude, causes material layer 400 to vibrate as indicated by 401 in response, which in turn causes changes to the magnetic flux thus altering induced current 204 in response. The sound represented by said induced current is thus altered as well.

Figure 5:
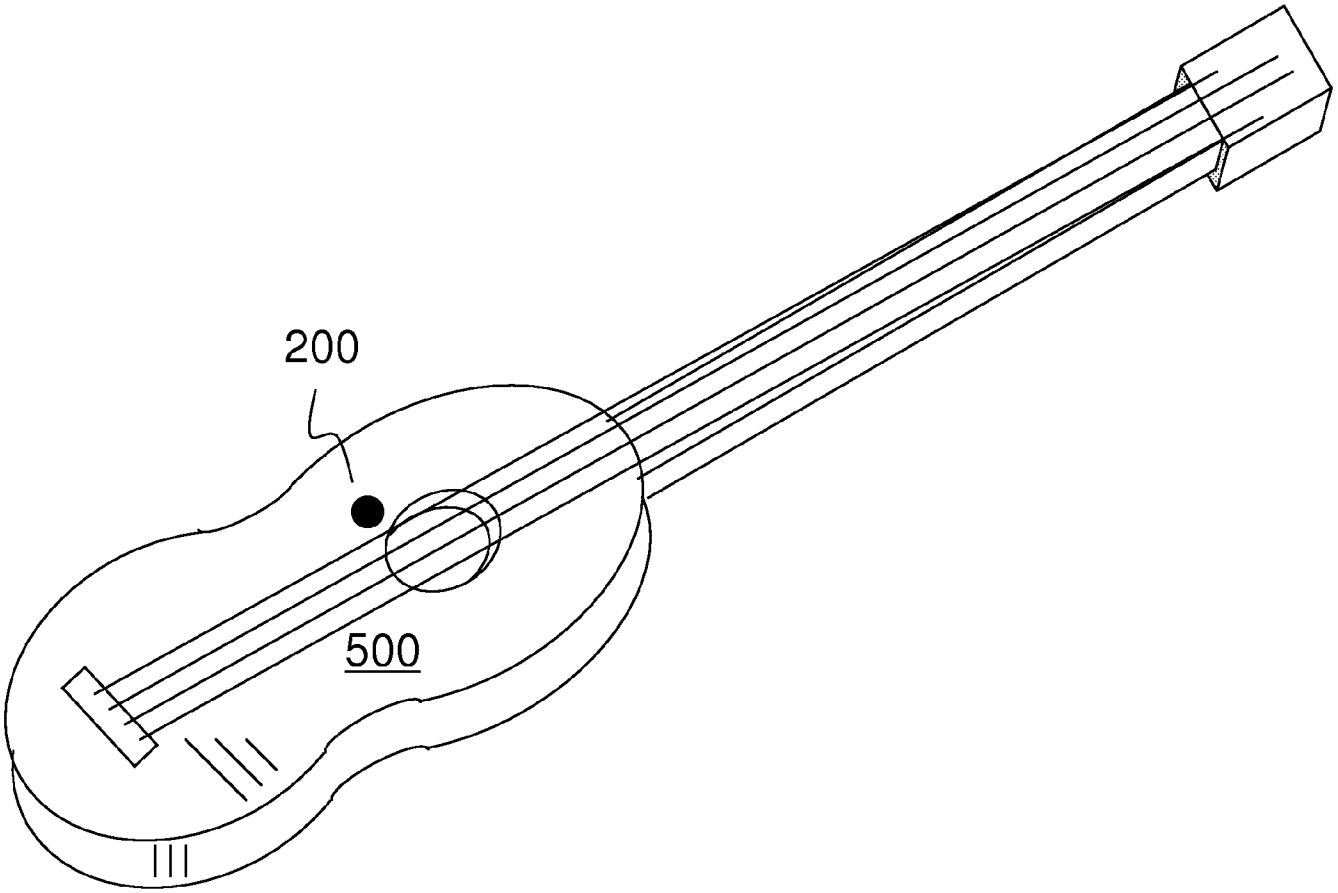
FIG. 5 illustrates an acoustic guitar-like instrument with an acoustic pick up

FIG. 5 illustrates an acoustic guitar-like instrument 500 with electronic sound pick up 200.

Figure 6:
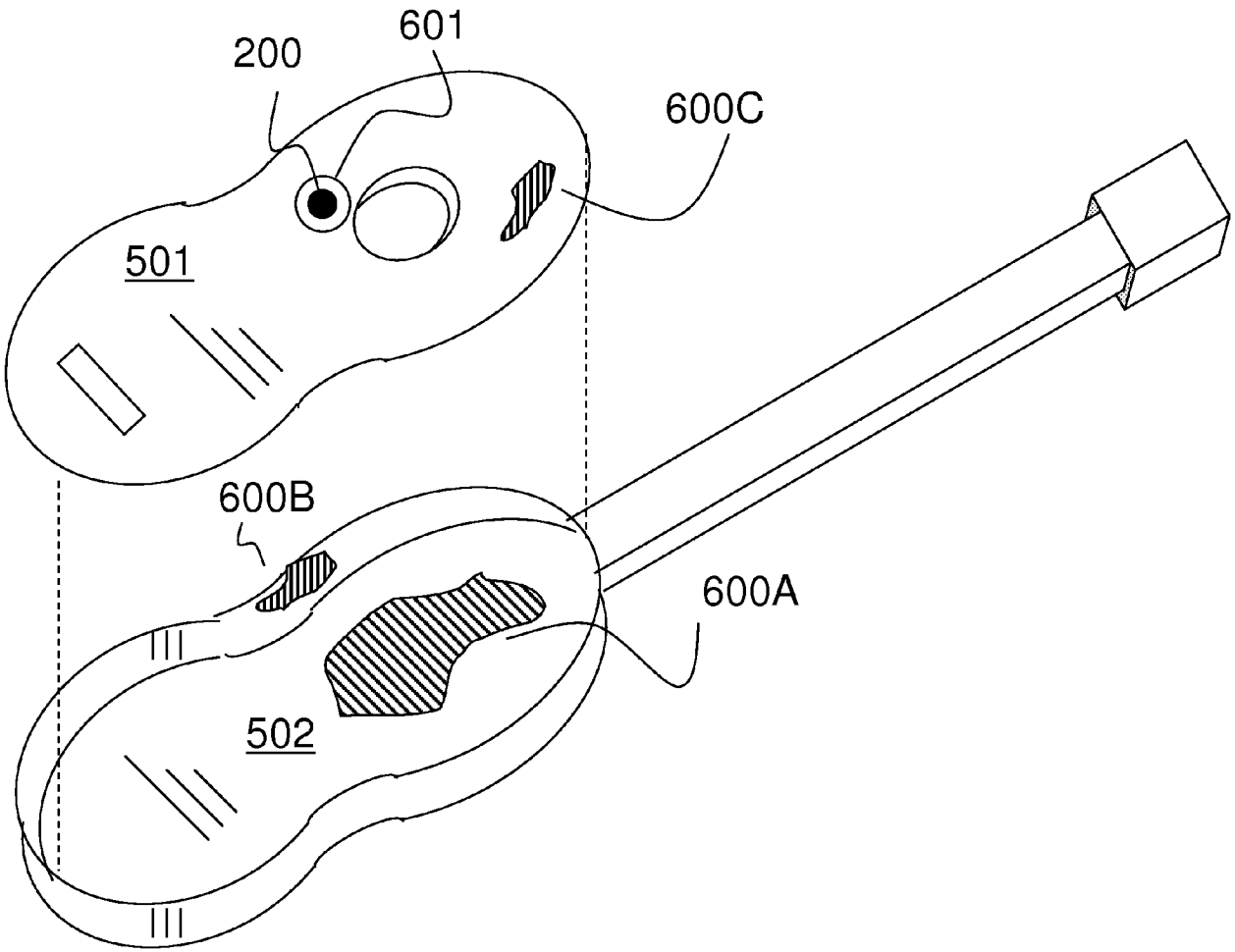
FIG. 6 illustrates a 3 dimensional exploded perspective image of the acoustic guitar-like instrument of FIG. 5 further highlighting places where a material capable of influencing a magnetic field from the pick up passing through it can be adhered to the surface.

FIG. 6 illustrates a three-dimensional exploded perspective view of acoustic guitar-like instrument 500 with base sound cavity 502 and flat sound cavity top 501. 600A, 600B and 600C illustrate a material that is added which adheres to various sections of the surface of the sound cavity that has metallic or magnetic properties that can alter a magnetic field passing through it. Dynamic microphone 200 produces a magnetic field, a portion of which passes through said material.

Materials capable of substantially altering a magnetic field are magnetic themselves or have a high permeability. Permeability is the measure of a material's ability to support the formation of a magnetic field. For example the permeability of iron can be on the order of 200,000 times greater than wood. Thus even a relatively thin and localized coating of a ferric material on an instrument can provide the vibrating wooden of an instrument with the ability to alert the instruments sound by altering the magnetic field.

Dynamic microphone 200 is affixed to said acoustic guitar-like instrument material or device 601 used to produced a dampening effect which substantially inhibits the instrument's vibration from vibrating said dynamic microphone. One embodiment of dampening device 601 could be a plastic material. Another embodiment could be a metallic spring clip where the inherent elasticity of the metal provides the dampening similar in some ways to how an automobile shock absorber operates.

Figure 7:
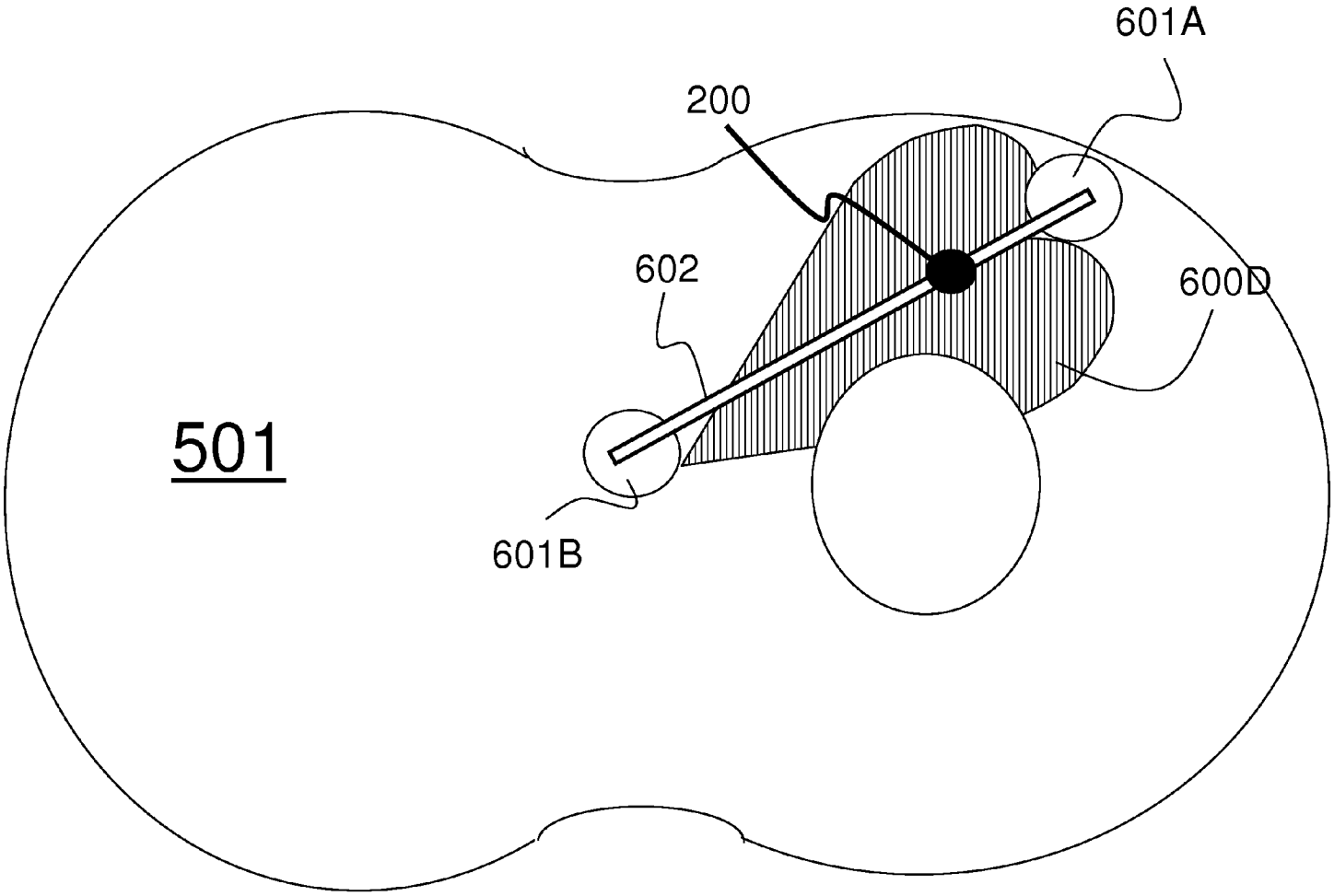
FIG. 7 illustrates one embodiment of a slide rail for the microphone to allow adjustment to the sound enhancements.

FIG. 7 illustrates top down view of the flat sound cavity top 501 of an acoustic guitar-like instrument 500. This illustration has the addition of acoustic pickup guide rail 602 attached to said flat sound cavity top via damping components 601A and 602B. Acoustic pickup 200 is attached to said guide rail 602 in a way where it remains substantially stationary until when sufficient force is applied causing it to slide back and forth along the rail. Moving said dynamic microphone 200 to areas with less of material 600D in its vicinity lessens the effect vibrating material 600D has on said microphone 200 by reducing the magnitude of the altered magnetic field passing through it. Moving dynamic microphone 200 to areas with more of material 600D in its vicinity increases the effect of vibrating material 600D has on said microphone 200 by increasing the magnitude of the altered magnetic field passing through it. The magnetic field produced by the vibration of material 600D affixed to the flat sound cavity top 501 can be varied thus producing differing sound effects.

What is claimed is:

1. A system that captures and alters sound produced by an acoustic instrument comprising:

A ferromagnetic surface coating that vibrates in response to sound produced by an acoustic instrument;

A dynamic microphone acoustic pickup in the vicinity of the surface coating whereby the electrical signal produced by said dynamic microphone acoustic pickup is further altered by the magnetic flux produced by the vibrations of said surface coating.

2. A system as in claim 1 where the surface coating is applied as an emulation that solidifies which contains particles that increase permeability and thus influence the magnetic field in its vicinity.

3. A system as in claim 1 where said surface coating is a varnish made from a lacquer or shellac or polyurethane-type liquid mixed with iron or magnetic particles.

4. A system as in claim 1 where the magnitude of alteration of the electric signal produced by the acoustic pickup by vibrations of said ferromagnetic material which is changed directly by a dampening means.

5. A system as in claim 1 where the magnitude of the alteration is changed by repositioning said acoustic pickup relative to said vibrating ferromagnetic material.

6. A method for enhancing sound produced by an acoustic musical instrument, comprising;

capturing sound generated by a sound source via a dynamic microphone acoustic pickup;

transforming said sound source sound into a corresponding electric signal;

placing ferromagnetic material in the vicinity of said acoustic pickup sufficiently close to said acoustic pickup that the magnetic flux produced by the vibrations of said ferromagnetic material further alter said electric signal.

7. A method as in claim 6 where the ferromagnetic material is a surface coating.

8. A method as in claim 6 where the surface coating is applied as an emulation that solidifies which contains particles that increase permeability and thus influence the magnetic field in its vicinity.

9. A method as in claim 6 where said surface coating is a varnish made from a lacquer or shellac or polyurethane-type liquid mixed with iron or magnetic particles.

10. A method as in claim 6 where the magnitude of alteration of the electric signal produced by the acoustic pickup by vibrations of said ferromagnetic material which is changed directly by a dampening means.

11. A method as in claim 6 where the magnitude of the alteration is changed by repositioning said acoustic pickup relative to said vibrating ferromagnetic material.

* * * * *